United States Patent [19]

Ludlum

[11] 4,014,288

[45] Mar. 29, 1977

[54] PADDING MACHINE

[75] Inventor: Lorren F. Ludlum, Fredonia, Kans.

[73] Assignees: William J. Falstad; Kenneth L. Mellon; Russel Spohn, all of Fredonia, Kans. ; part interest to each

[22] Filed: June 2, 1975

[21] Appl. No.: 582,682

[52] U.S. Cl. ..... 118/6; 118/230; 118/244

[51] Int. Cl.[2] ..... B05C 1/02

[58] Field of Search ..... 11/1 AD; 156/477 B, 156/528; 118/230, 231, 2, 6, 503, 101, 244

[56] References Cited

UNITED STATES PATENTS

| | | | |
|---|---|---|---|
| 1,989,471 | 1/1935 | Belcher | 118/230 X |
| 2,016,933 | 10/1935 | Smith et al. | 118/230 X |

*Primary Examiner*—John P. McIntosh
*Attorney, Agent, or Firm*—D. A. N. Chase

[57] ABSTRACT

A machine is disclosed for automatically applying glue to one edge of a multi-leaved paper product to form a pad or book. A plurality of trays are mounted on a wheel-like carrier which is incrementally rotated about a horizontal axis to advance the trays in a circular path. The trays lie essentially in angularly spaced planes intersecting at a common line that is the axis of the carrier, and are loaded on at a time after arriving at a loading position in which the tray to be loaded is horizontally disposed with its receiving surface facing upwardly. Each product is hand loaded into the respective tray from outside the circular carrier, with the inside edge being placed against a jogging bar that is parallel to the carrier axis. The loaded product is sensed by a microswitch and, after a delay period during which time a holding clamp on the tray engages the product, the carrier is automatically advanced one increment to move the next tray to the loading position. Glue is applied to the inside edges of the products as the trays pass in succession between a pair of adjacent positions at the top of the circular path; an applicator roll is disposed with its axis parallel to the carrier axis so that the entire length of each advancing edge is glued in a transverse sweep. The holding clamp of each tray disengages to release the finished product and deliver the same after the tray passes the bottom of the circular path on its way back to the loading position.

14 Claims, 11 Drawing Figures

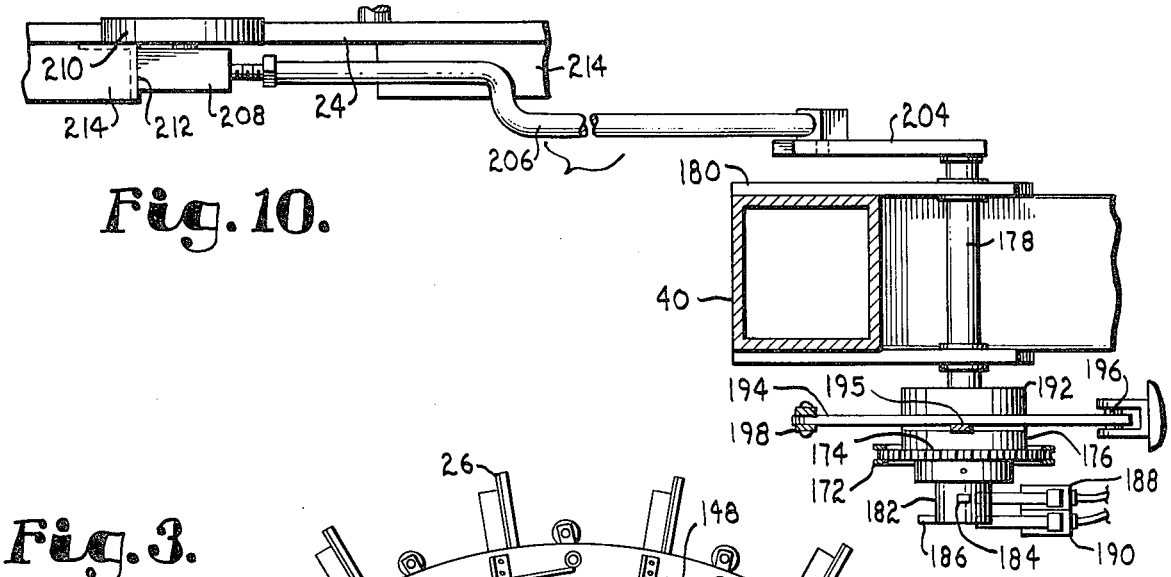
Fig. 10.
Fig. 3.
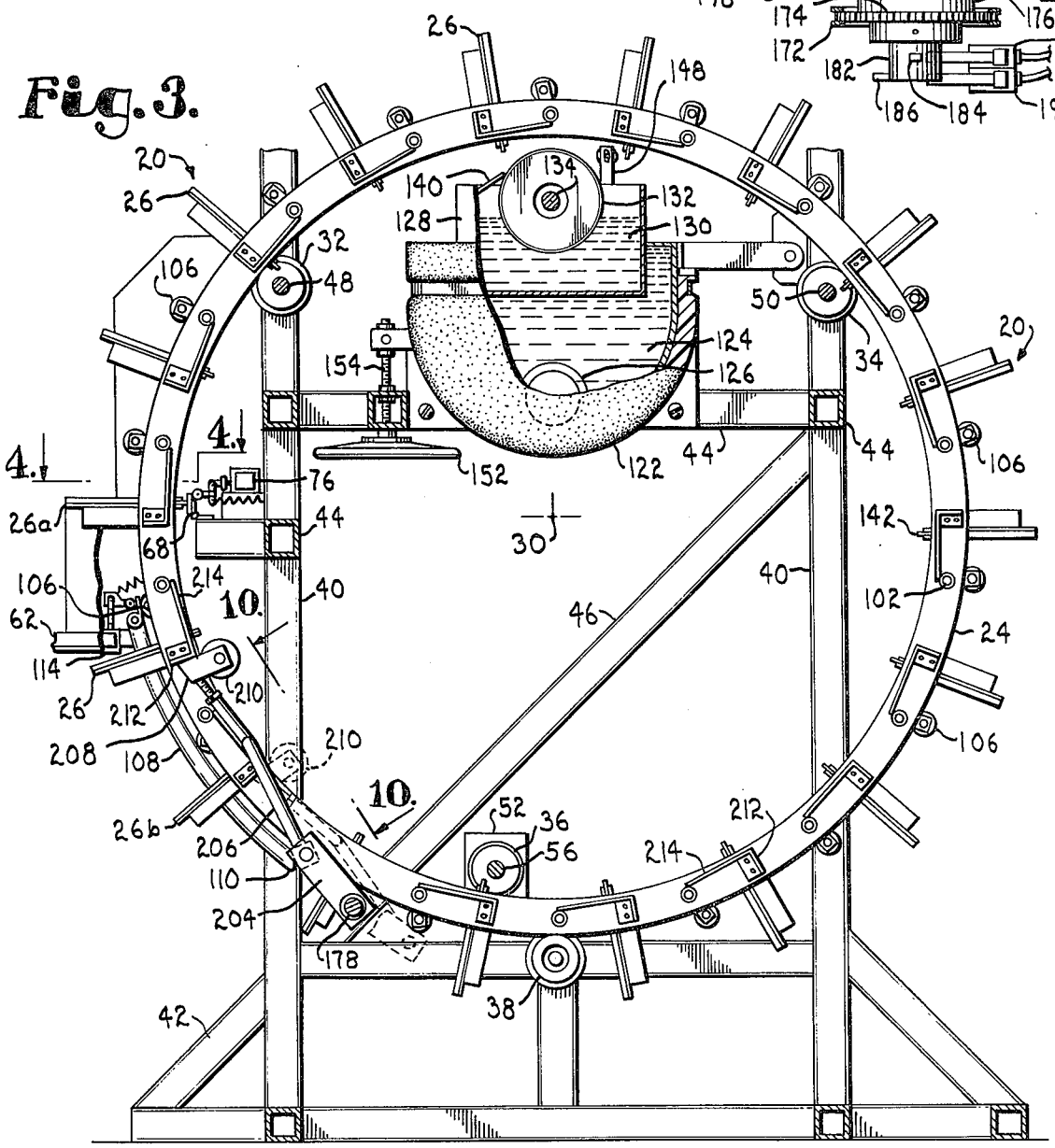

Fig. 6.
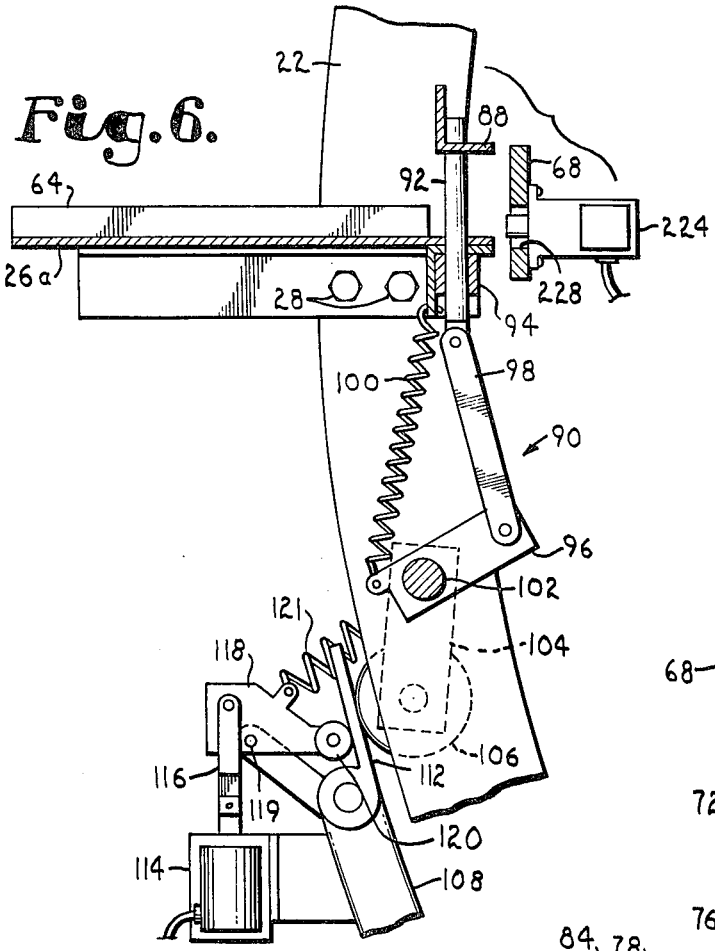
Fig. 5.
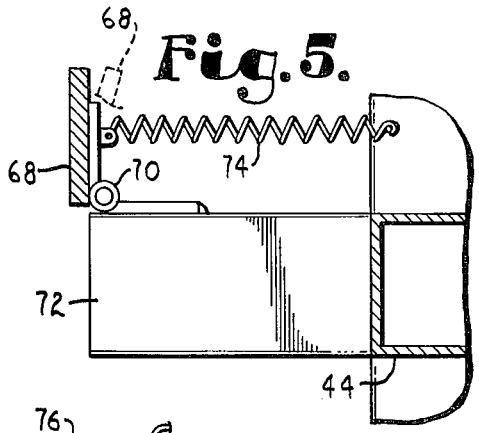
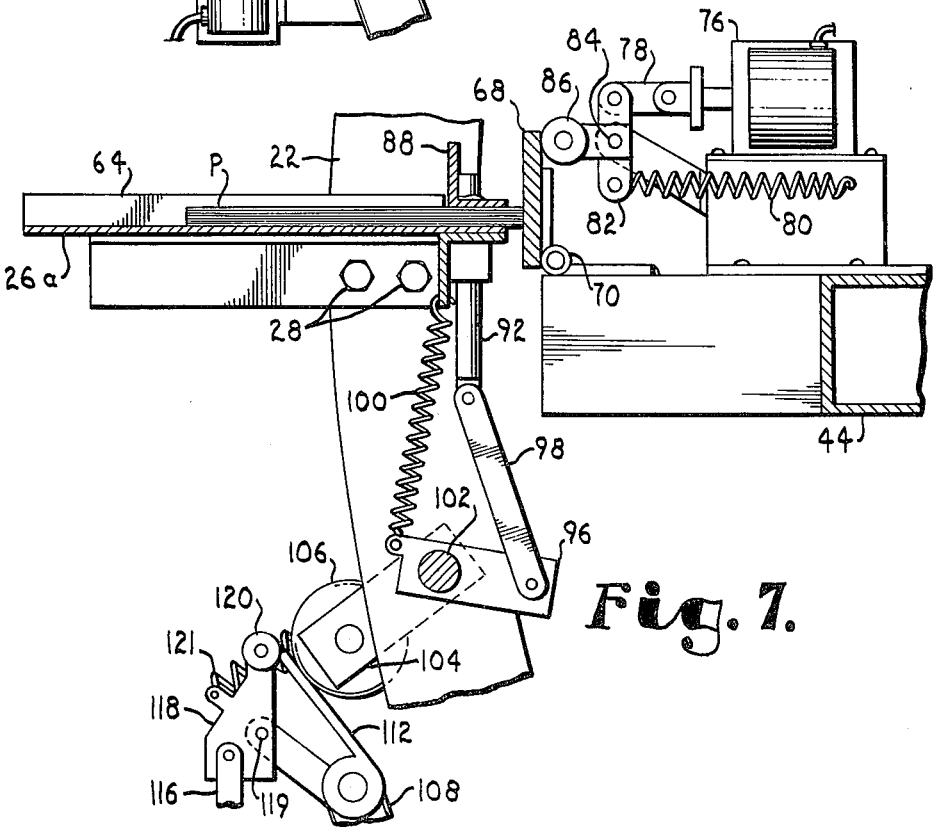
Fig. 7.

PADDING MACHINE

This invention relates to improvements in machines for automatically applying glue to paper products and the like to form finished pads or books.

One type of commercially available padding machine in use at the present time employs a pair of opposed conveyor belts which advance the unfinished pads over a glue wheel. The belts are arranged so that they face each other in horizontal planes, the unfinished products being hand-loaded into the belts and sandwiched therebetween as they are carried in succession over the glue wheel with the edges thereof to be glued advancing longitudinally in contact with the glue-covered surface of the wheel.

There are two basic problems with a machine of the type just described. First of all, time is required to set up the machine for a particular pad thickness since the distance between the conveying belts is critical. Once the distance is set, the pads must be of uniform thickness (containing approximately the same number of sheets or leaves) within a rather narrow range, as a pad having a greater thickness than the tolerated range cannot be accommodated and a thinner pad will not be carried by the opposed belts. Secondly, time must be allowed after the glue is applied and before delivery of the finished pad for the glue to dry or set sufficiently. This normally requires a refrigeration unit between the gluing station and the delivery end of the conveyor which, of course, adds significantly to the overall cost of the machine.

A second prior approach in the design of padding machines is to employ a horizontally extending series of clamps arranged end to end on a stand in the nature of a carousel which rotates about a vertical axis. The clamps are hand-loaded one at a time as they advance to a loading table area upon which stacks of unfinished pads or books to be glued are stacked for the convenience of the operator. Each pad is loaded in a vertical orientation with the edge to be glued presenting the lower edge of the pad. As in the belt conveyor machine discussed above, this lower edge is advanced over a glue applicator after leaving the loading table area. Ultimately, each clamp is released as it reaches a delivery position. In such an arrangement, it may be appreciated that the drying time for the glue is limited to the number of increments of rotation from the gluing station to the delivery position. Furthermore, since the clamps are arranged in a circular array that is disposed in a horizontal plane, there is an inherent limitation on the number of clamps (and hence the number of increments between gluing and delivery) dictated by the horizontal expanse of the machine. Unless a large floor area in a production facility is to be reserved for automatic padding operations, there is a practical limit on the capacity of the machine as it is naturally proportional to the circumference of the carousel or rotating stand.

It is, therefore, a general object of the present invention to provide a padding machine which overcomes the difficulties outlined above with respect to either the belt conveyor or carousel type machine.

Another important object of this invention is to provide a padding machine in which there is no setup time and in which the pad thickness is immaterial so long as it is less than a certain maximum thickness that the machine is designed to accommodate.

Still another important object of the invention is to provide a padding machine as aforesaid of increased capacity, and which is capable of handling pads as fast as they can be loaded by a skilled operator.

Still another object of the invention is to provide a padding machine as aforesaid employing incremental advancement of feeder units (each loaded with a pad to be glued) from a loading position, past a gluing station to a delivery position, and then back to the loading position in a continuous circuit, wherein adequate time for air-drying of the glue is assured regardless of the speed at which the machine is being operated and without the necessity of employing auxiliary mechanical equipment to decrease the drying time.

Yet another important object of the invention is to provide a padding machine as aforesaid of high capacity which makes maximum use of available floor area by advancing the feeder units in a circular path about a horizontal axis.

Furthermore, it is an important object of this invention to provide a padding machine in which the path of the pads is in a vertical plane, and wherein trays are employed to receive the pads and transport the same along such path with the tray at the loading position being horizontally disposed to receive an unfinished pad flat thereon to thereby facilitate rapid and accurate loading of the unfinished products.

Additionally, it is an important object of this invention to provide a machine as in the last object above wherein the inner edge of each pad (the edge to which glue is to be applied) is placed against a jogging bar as the pad is loaded, thus assuring that the edge will not be uneven.

Still further, an important object of the invention is to provide a machine of this type capable of applying glue to the edge of the product in a transverse rather than a longitudinal sweep and in a manner to assure uniform distribution of the glue thereon.

SUMMARY OF THE INVENTION

A plurality of feeder units (18 in number in the embodiment illustrated herein) are mounted on a wheel-like carrier which is incrementally rotated about a horizontal axis by a drive that responds to the loading of one of the units of the series located at a predetermined loading position. Each feeder unit has a tray for receiving an unfinished pad of paper or similar multi-leaved product. These trays of the units lie essentially in equally angularly spaced planes intersecting at a common line that is the horizontal axis of the carrier. A loading area is provided at the front of the machine by tabletops or other supporting surfaces to facilitate the handling of the unfinished pads or books by the operator. Each tray, as it is advanced, moves upwardly out of the loading area and the next tray rises from beneath into the loading position.

The tray at the loading position is horizontally disposed, and a pad is placed in such tray flat against its receiving surface with either the left or the right edge of the pad against a corresponding side guide. The inside edge of the pad is placed against an edge guide that extends parallel to the horizontal axis of rotation of the carrier. Such edge guide provides a jogging bar for the inside edge of the pad which is the edge to which the glue will be applied. The presence of the loaded pad is automatically sensed and adequate time is provided for the completion of proper placement of the pad against the guides, whereupon a clamp moves downwardly into engagement with the top of the pad to securely hold it in place on the tray. Thereafter, the jogging bar is shifted clear of the tray and pad and the carrier advances one increment to bring the next tray into the loading position. This repeats indefinitely depending upon the speed of the operator in hand-loading the successive trays.

A gluing station is located at the top of the circular path traversed by the trays and is radially inwardly spaced therefrom for the purpose of applying glue to the exposed inside edge of each pad (now the lower edge) as it passes thereover. A glue roll is employed that is arranged with its axis of rotation parallel with the axis of the carrier and is driven at a surface speed equal to the speed of the advancing edge as it passes in contact with the surface of the roll. Accordingly, the entire length of the advancing edge simultaneously meets the roll and glue is transferred thereto in a transverse sweep. A horizontal stripper wire removes any excess.

In the embodiment illustrated herein, the pad after the glue is applied advances a total of eleven increments before the tray reaches the delivery position, which is past the bottom of the circular path and beneath the loading position. This provides adequate time for the glue to set regardless of the speed at which the operator can load the trays. As each tray reaches the delivery position, the holding clamp disengages to release the finished product for delivery by gravity.

DESCRIPTION OF THE DRAWINGS

FIG. 3 is a vertical sectional view taken along line 3—3 of FIG. 1 and reveals details of the circular carrier, the incremental drive, and the gluing station, also as seen from the right side;

FIG. 5 is a fragmentary, vertical cross-section taken essentially along line 5—5 of FIG. 4, and illustrates certain features of the jogging bar arrangement;

FIG. 6 is a fragmentary, vertical cross-section taken essentially along line 6—6 of FIG. 4, and shows the clamp raised prior to loading of the tray;

FIG. 7 is a fragmentary, vertical cross-section taken essentially along line 7—7 of FIG. 4, and shows the clamp engaged with the loaded pad following energization of the clamp actuating solenoid;

FIG. 10 is an enlarged, fragmentary, cross-sectional view taken along line 10—10 of FIG. 4, and illustrates the drive rod and associated crank and clutch mechanism.

THE CARRIER

Figure 4:
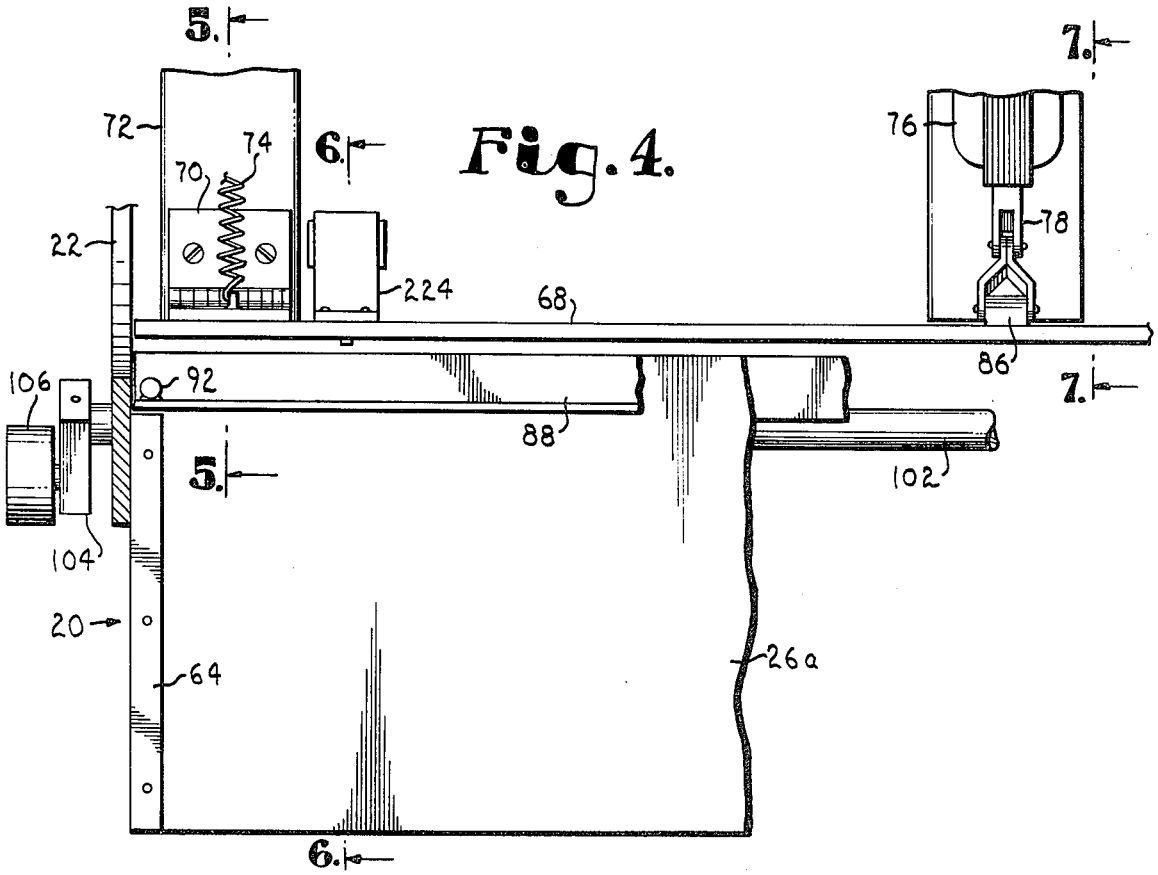
FIG. 4 is an enlarged, fragmentary, horizontal cross-section taken along line 4—4 of FIG. 3, looking downwardly on the horizontal tray at the loading position.

Referring to FIGS. 1–4, each of the feeder units of the present invention is broadly denoted by the reference numeral 20. These units are mounted are on wheel-like carrier comprising a pair of circular frame members 22 and 24 disposed in horizontally spaced, vertical planes. The feeder units 20 span the frame members 22 and 23, each unit 20 including an elongated tray 26 secured at its ends to the frame members 22 and 24 by bolts 28. The tray denoted **26*a* is at the loading position, and the tray denoted 26*b* is at the delivery position. In FIG. 4, the bolts 28 securing the left edge of the tray 26*a* to the left frame member 22** are not illustrated in the interest of clarity.

Figure 2:
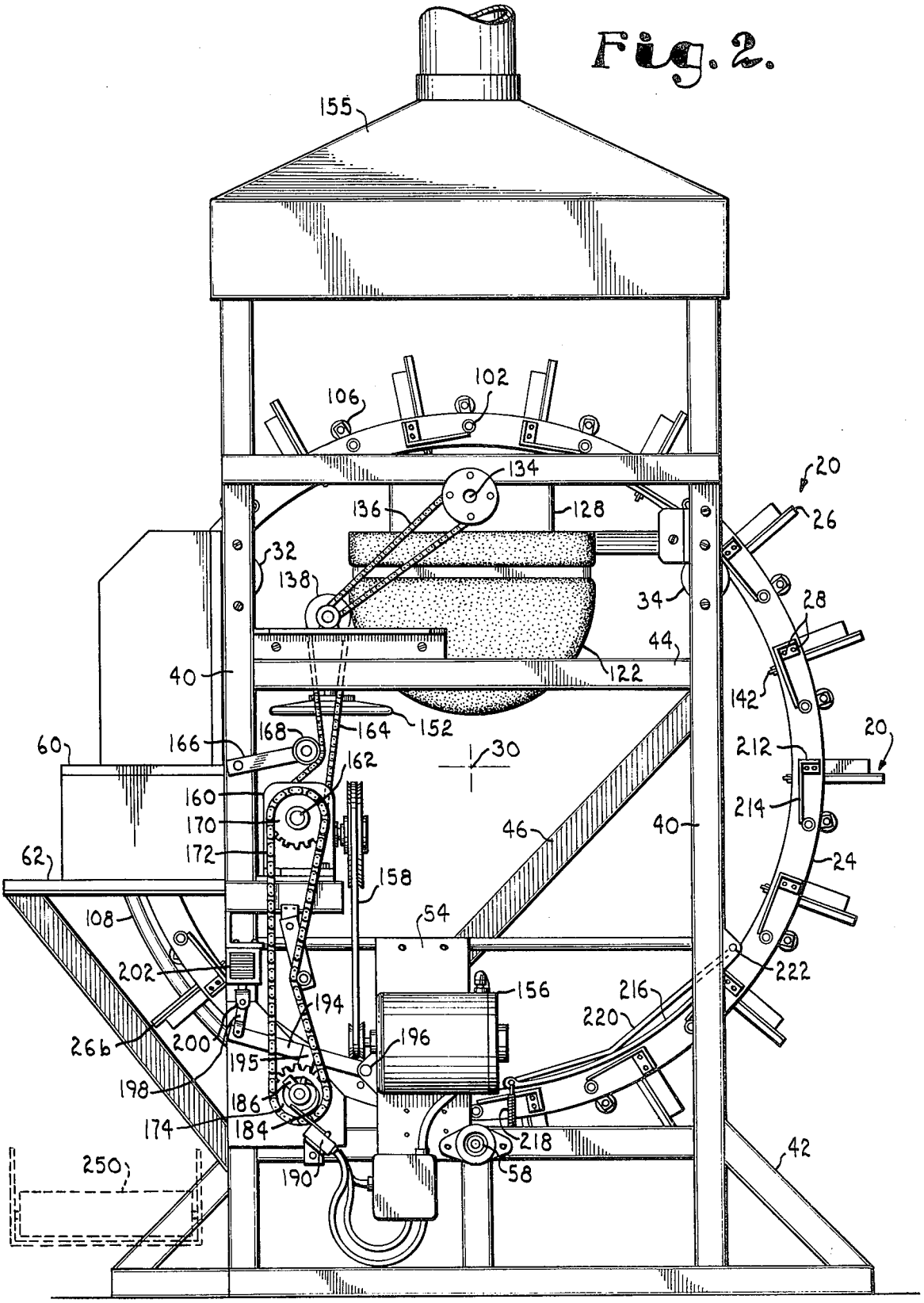
FIG. 2 is an elevational view of the machine as seen from the right side thereof.

The circular carrier is supported by a framework for rotation about a horizontal axis designated by the point 30 in FIGS. 2 and 3. The axis 30 is at the centers of the circular frame members 22 and 24, the same being mounted on four sets of bearing wheels 32, 34, 36 and 38. There are two bearing wheels in each set engaging corresponding members 22 and 24; it may be seen in FIG. 3 that the wheels 32, 34 and 36 are inside the frame members 22 and 24, whereas the set of wheels 38 is outside at the bottom.

The stationary framework supporting the carrier structure includes four upright standards 40 braced at their lower ends by a base frame assembly 42. Horizontal cross members 44 and diagonal members 46 span the standards 40 and complete the rigid framework. The set of bearing wheels 32 are secured to a rotatable cross shaft 48 carried by the two standards 40 at the front of the machine; likewise, the wheels 34 rotate with a cross shaft 50 whose ends are held in bearings on the two standards 40 at the rear of the machine. An upright support plate 52 on the left side of the machine and a mounting plate 54 on the right side thereof rotatably support the opposite ends of a cross shaft 56 on which the set of wheels 36 is secured. A pair of bearing assemblies 58 on opposite sides of the machine at the base support the two wheels 38 that underlie the circular frame members 22 and 24 of the carrier.

THE FEEDER UNITS

Referring particularly to FIGS. 1, 3–7 and 9, the feeder unit 20 at the loading position will be described in detail. As mentioned above, the tray of such unit is designated **26*a*; this is the unit 20 illustrated in FIG. 4–7. The tray 26*a* is horizontal and is located at the front of the machine at the vertical center of the circular path traversed by each unit 20 as the wheel-like carrier is rotated about the horizontal axis 30. A loading area is provided at the front of the machine and includes a support table assembly with side work surfaces 60 and a front work surface 62 seen in FIG. 1 (see also FIG. 2). These surfaces 60 and 62 are used by the operator for stacking and hand jogging pads prior to loading the same into the feeder units. The side work surfaces 60 flank the tray 26*a*** in the loading position and are essentially coplanar with the upper surface thereof.

Figure 1:
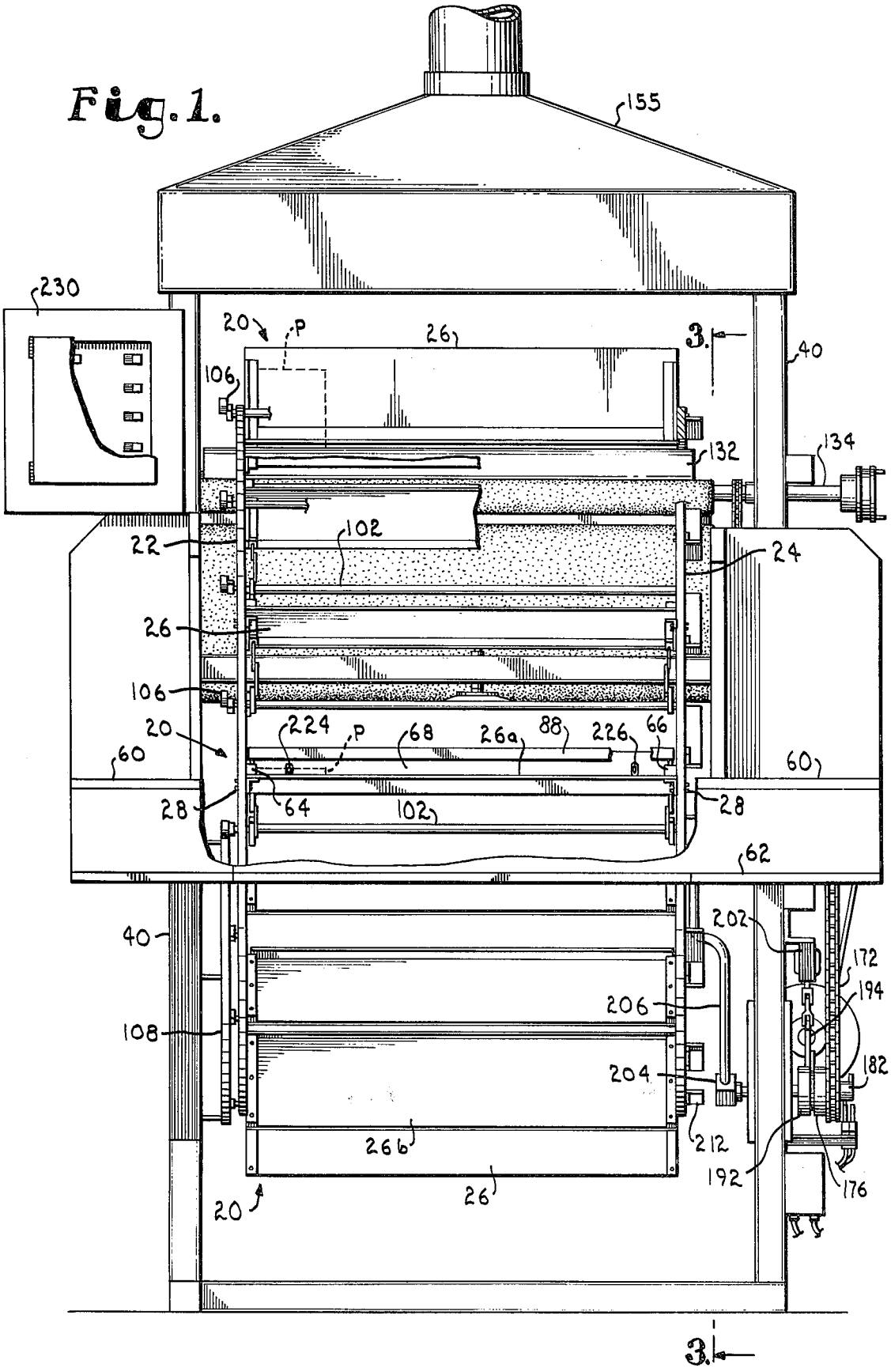
FIG. 1 is a front elevational view of the padding machine of the present invention, certain parts being broken away to reveal details of construction.

As is clear in FIGS. 4, 6 and 7, a side guide 64 is secured to the left edge of the tray **26*a*; a similar guide 66 is secured to the right edge of tray 26** and is visible in FIG. 1. These serve as side guides for a pad loaded into the tray, either of which may be used at the option of the operator. A loaded pad is seen at P in FIG. 7 and is illustrated in phantom lines in FIG. 1 against the left guide 64.

A guide for the inside edge of the pad is provided by a horizontal jogging bar 68 which extends parallel to the axis 30 of the rotatable carrier. Hinges 70 mount the bar 68 on frame extensions 72 that project forwardly from the adjacent cross member 44 of the stationary framework. The normal, operative position of the jogging bar 68 is shown in full lines in the illustrations, where it may be seen that the bar 68 presents a vertical front surface against which the inside edge of the pad P is placed (FIG. 7). The broken line position of the bar 68 illustrated in FIG. 5 shows the position assumed during rotation of the carrier, in which position the bar 68 is clear of the tray and pad. Movement of the bar 68 to such position is accomplished by a spring 74 upon energization of a solenoid 76. Normally, as seen in FIG. 7, the armature 78 of the solenoid 76 is held extended by a return spring 80 connected to the armature 78 by a crank link 82 supported on a pivot pin 84. A roller 86 is mounted on the crank link 82 and normally bears against the back side of the jogging bar 68 to lock the same in the vertical position.

In order to hold the pad P or other work in place on the tray 26*a*, a clamp 88 is employed and is controlled by an operating mechanism broadly denoted 90. The clamp 88 is formed by an angle member arranged to present a horizontal bar with a lower surface movable into flush engagement with the top of the pad P. The clamp 88 is supported at its ends on a pair of posts 92 located at the inner corners of the tray 26*a*. Each of the posts 92 is longitudinally reciprocable in a sleeve bearing 94 as may be seen by a comparison of FIGS. 6 and 7. With respect to each of the posts 92, the operating mechanism has a crank 96 pivotally connected to one end of a link 98, the opposite end thereof being pivotally connected to the lower end of the post 92 (the term "lower" in the present description refers to the orientation of parts when the feeder unit 20 is at the loading position). The end of the crank 96 opposite the link 98 is connected by a spring 100 to the tray 26*a*. An identical arrangement exists for the post 92 at the right side of the tray 26*a*, the two cranks 96 being interconnected by a cross shaft 102 for rotation in unison.

The cross shaft 102 is journaled in the circular frame members 22 and 24 of the carrier; the left end thereof projects from the member 22 (FIG. 4) and is provided with a crank arm 104 having a roller 106 on its outer end. An arcuate rail 108 is supported by the stationary framework of the machine and is disposed adjacent the perimeter of the circular frame member 22 in concentric relationship therewith. The lower end 110 (FIG. 9) of the rail 108 is associated with the delivery position of the feeder units 20, whereas the upper end of the rail 108 is associated with the loading position and is presented by a hinged end piece 112. In the loading position, the roller 106 is in engagement with the end piece 112, the latter being held in place as an effective part of the rail 108 as illustrated in FIG. 6.

A clamp actuating solenoid 114 is mounted on the rail 108 adjacent its upper end and is normally de-energized with its armature 116 vertically extended as shown in FIG. 6. A trip dog 118 carries a roller 120 and pivots on a pin 119, the armature 116 being pivotally connected to the dog 118 at a point spaced from the pivot pin 119. A return spring 121 is connected to the dog 118 and normally holds the roller 120 in engagement with the end piece 112 (FIG. 6). When the solenoid 114 is energized, it withdraws the armature 116 downwardly to rotate the dog 118 in a counterclockwise direction as viewed in FIG. 7, thereby tripping the end piece 112 to actuate the mechanism 90 and cause the clamp 88 to close against the pad P under the action of the springs 100.

THE GLUING STATION

Figure 8:
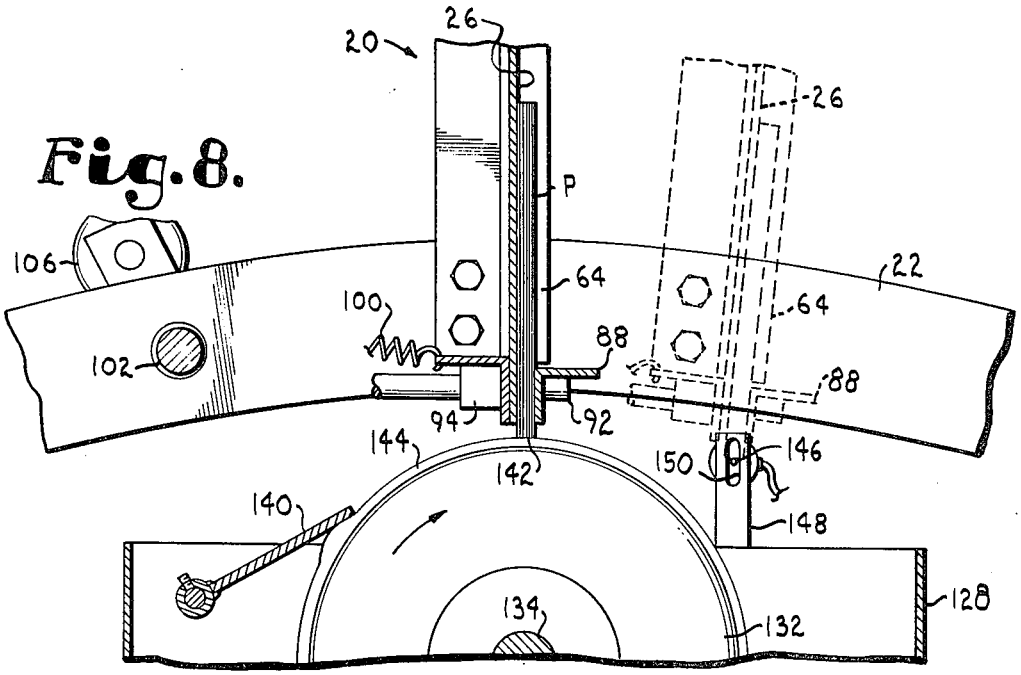
FIG. 8 is an enlarged, fragmentary, vertical cross-section taken through the glue pot and roll and viewing the same from the right side as in FIGS. 2 and 3, and illustrates the manner in which glue is applied to the edge of a pad and the excess removed by the stripper wire.

Referring primarily to FIGS. 2, 3 and 8, the gluing station is located at the top of the circular path traveled by the trays 26 and is radially inwardly spaced from the trays. A trough 122 is supported by adjacent horizontal cross members of the stationary framework and contains a quantity of oil 124. An electrical heater element 126 is immersed in the oil 124 for the purpose of heating the oil to a temperature on the order of 350° F. A glue pot 128 is supported in the trough 122 and is partially filled with glue 130. As is clear in FIG. 3, the bottom of the pot 128 is well below the upper surface of the oil 124 so as to maximize the heat transfer from the oil to the glue. It should be understood that the heating arrangement illustrated herein is purely exemplary, and that any suitable conventional means may be employed to maintain the glue 130 at the proper temperature (commonly about 350° F. for the conventional hot melt adhesive used for paper scratch pads and the like).

A glue applicator in the form of a cylindrical roll 132 is partially submerged in the glue 130 and is oriented with its axis directly above and parallel to the horizontal axis of rotation 30 of the carrier. The roll 132 has an axial shaft 134 journaled in the pot 128, a drive chain 136 being employed to connect the shaft with an idler assembly 138 forming a part of the machine drive (to be subsequently discussed). The roll 132 is rotated in a clockwise direction as viewed in FIGS. 2, 3 and 8, and a spreader 140 bears against the wetted surface of the roll to evenly distribute the glue thereover (FIG. 8).

One of the feeder units 20 is shown in FIG. 8 advancing between two adjacent positions at the top of the circular path. The full line illustration shows the pad P carried by the unit 20 at top dead center with its inside edge 142 in contact with the glue covered outer surface of the roll 132. The roll 132 extends the entire length of the tray 26 between the side guides 64 and 66 thereof; accordingly, it may be appreciated that the surface of the roll 132 presents an elongated zone of contact 144 that is parallel with the edge 142 as well as the rotative axis 30 of the carrier. Such zone of contact 144 is engaged by the edge 142 as it passes over the roll 132; thus the entire length of the edge 142 has glue simultaneously applied thereto in a transverse sweep. The speed of rotation of the roll 132 is controlled so that the surface speed of the roll equals the speed of the advancing edge 142 as it passes in contact; this precludes the pile-up of glue on the leading or trailing portions of the edge 142.

A horizontal stripper wire 146 is parallel to the axis of the roll 132 and is spaced ahead of the roll just beneath the edge 142 as it passes thereover (as illustrated in phantom lines in FIG. 8). The stripper wire 146 is a resistance wire that is electrically heated to approximately 250° F. and is closely spaced from the edge 142 in order to remove any excess glue therefrom. The wire 146 is supported at its ends by a pair of upright support elements, one of which is visible at 148 in the cross section of FIG. 8. To control the spacing from the edge 142, the ends of the wire 146 are vertically adjustable in slots 150 in the support elements 148. Likewise, the vertical position of the glue roll 132 is adjustable by a hand wheel 152 on a vertical screw 154, a rotation thereof causing raising or lowering of the oil trough 122 (FIG. 3).

In view of the heat associated with the gluing station, a ventilation hood 155 is provided above the top of the path of the feeder units 20. The hood is mounted on the upper ends of the standards 40 as may be seen in FIGS. 1 and 2.

CONTROL CIRCUITRY AND DRIVE

Referring initially to FIGS. 2, 3 and 10, an electric motor 156 is secured to the mounting plate 54 and, via a belt and pulley assembly 158, drives a gear reduction transmission 160. The output shaft 162 of the transmission 160 is provided with a pulley (hidden from view in FIG. 2) about which a belt 164 is trained, such belt 164 transmitting drive to a pulley in the idler assembly 138. These two pulleys interconnected by belt 164 are of the variable speed type so that the rotative speed of the glue roll 132 may be adjusted to equalize the surface speed of the roll and the speed of the advancing edge to be glued, as discussed above. This is accomplished by an adjustable belt tightener (illustrated in FIG. 2) comprising a pivotal arm 166 carrying an idler pulley 168 that runs on the belt 164. By changing the tension of the belt 164 in the grooves of the variable speed pulleys, the speed of the glue roll is adjusted as necessary for proper synchronism.

The output shaft 162 of the transmission 160 is also provided with a sprocket 170 in engagement with a drive chain 172 that is trained around a sprocket 174 forming a part of a rotatable collar 176 (FIG. 10). A driven shaft 178 is journaled in a bracket 180 that is rigidly secured to the stationary framework of the machine adjacent the base assembly 42. The outer end of shaft 178 (toward the viewer in FIGS. 2 and 3) has a smaller collar 182 fixed thereto for rotation with the shaft 178. This collar 182 carries a pair of cams 184 and 186 which operate a pair of cam switches 188 and 190 respectively.

The collar 176 and associated sprocket 174 are a unitary assembly rotatable on the shaft 178, and are opposed by a collar 192 which is fixed to the shaft 178. These comprise the basic components of a one revolution mechanical clutch which is operated by the raising and lowering of an arm 194 that carries a lug 195 (FIG. 2) movable with the arm 194 into and out of the space between the collars 176 and 192. The right end of the arm 194 (as viewed in FIGS. 2 and 10) is mounted adjacent the housing of the motor 156 by a pivot pin 196, the left end of the arm 194 being pivotally attached by a link 198 to the armature 200 of a clutch solenoid 202.

The inner end of the driven shaft 178 operates a crank 204 to which one end of a drive rod 206 is pivotally connected. The opposite end of the drive rod 206 presents a drive head 208 that carries a roller 210 which normally rides on the inner, circular surface of the carrier frame member 24. The head 208 is engageable with a laterally projecting lug 212 on the frame member 24, there being a series of such lugs 212 spaced at equal intervals around the member 24. One of the lugs 212 corresponds to a particular one of the feeder units 20; thus there are eighteen lugs 212 in the illustrated embodiment.

Each lug 212 is presented by an L-shaped metal piece, the longer stretch of such piece defining a ramp 214 that extends from the lug 212 in the general direction of movement of the carrier (clockwise in FIGS. 2 and 3). The metal pieces are secured to the right side of the frame member 24 by the bolts 28 used to attach the respective trays 26.

Regarding the clutch mechanism employing the collars 176 and 192, it should be understood that the mechanical clutch illustrated herein is purely exemplary. As will be appreciated from the discussion of operation to follow, it is only important that the clutch mechanism cause the driven shaft 178 to undergo one complete revolution in response to momentary energization of the clutch solenoid 202. The mechanical clutch illustrated herein is of conventional design and employs a sliding pin carried by the collar 192 that is fixed to the driven shaft 178. The pin is spring-biased to yieldably extend toward the rotating collar 176 and mate with an opening in its face to couple the two collars together. This is permitted when the lug 195 is momentarily withdrawn to release the pin. Thereafter, when the lug 195 is lowered back into the space between the collars 176 and 192, it provides an abutment which the pin strikes to thereby withdraw the pin against its spring by a camming action.

In order that the carrier will stop immediately after the clutch disengages, a drag strip 216 (FIG. 2) overlies a portion of the circular inner surface of the frame member 24 adjacent the base of the machine and is loaded against the member by a spring 218. An elongated brace 220 engages the upper surface of the strip 216 to hold the lower surface thereof in frictional contact with the frame member 24. The upper end of the brace 220 is pivoted at 222, and the lower end thereof has a common connection with the spring 218 and the lower end of the strip 216.

In normal operation, the incremental advancement of the carrier is initiated by either a left microswitch 224 or a right microswitch 226 mounted on the jogging bar 68 (FIGS. 1, 4 and 6). The left microswitch 224 is adjacent the left side guide 64 of the tray **26*a* at the loading position; likewise, the right microswitch 226 is adjacent the right side guide 66. As is clear in FIG. 6 with respect to the left microswitch 224, an aperture 228 in the jogging bar 68 permits the actuator button of the microswitch 224 to project forwardly from the front surface of the bar 68 where it will be contacted and depressed by a pad when the same is loaded into the tray 26*a*. The actuator button of the right microswitch 226 is similarly arranged so that pads loaded against either the left side guide 64 or the right side guide 66** will be sensed.

A switchbox 230 for the electrical system of the machine is seen in FIG. 1 mounted adjacent the upper end of the left front standard 40. More particularly, referring to FIG. 11, the electrical system is shown in detail including the control circuitry associated with the drive and the gluing station. A number of the elements of the circuitry have previously been described in connection with the mechanical drawings of FIGS. 1–10; such elements bear the same reference numerals in the electrical schematic diagram of FIG. 11. The microswitches 224 and 226 and the cam switches 188 and 190 are normally open as shown in FIG. 11; this corresponds to the condition of the machine when the carrier is at rest and the tray **26*a*** at the loading position is yet to be loaded.

Figure 11:
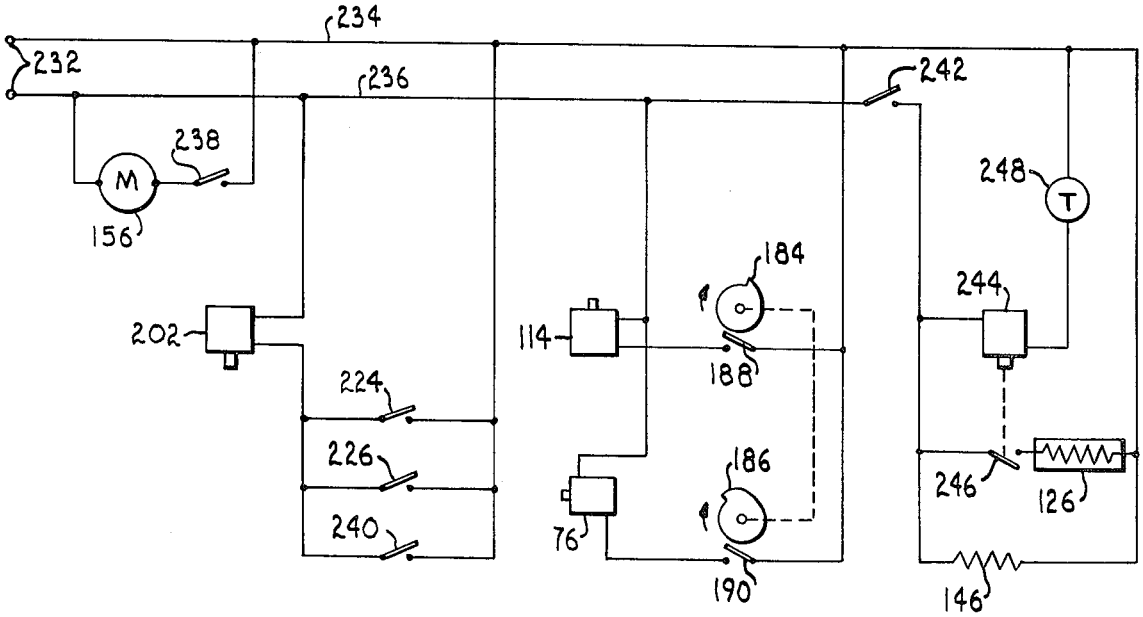
FIG. 11 is an electrical schematic diagram of the control circuitry of the machine.

The supply terminals 232 in FIG. 11 represent a conventional electrical power source such as 110 or 220 volts of alternating current. Lines 234 and 236 extend from the terminals 232 and supply four parallel circuits that function independently of one another. The first is the power circuit to the motor 156, the latter being controlled by an on/off switch 238. The second is a circuit from lines 234 and 236 to the clutch solenoid 202 via the microswitches 224 and 226 and a third, clear switch 240. The three switches 224, 226 and 240 are connected and parallel so that closure of either switch energizes the solenoid 202. The clear switch 240 is normally open and is a manual switch that is closed at the end of a run after the last tray 26*a* is loaded.

The third section of the circuitry of FIG. 11 involves the clamp actuating solenoid 114 and the jogging bar solenoid 76, both of which are operated by their respective cam switches 188 and 190. The cams 184 and 186 rotate in a clockwise sense as illustrated by the arrows, the leading edge of the cam 184 being slightly ahead of the leading edge of the broader cam 186.

The fourth section of the circuitry is enabled by an on/off switch 242 and includes a relay coil 244, its associated normally open relay switch 246, and a thermostat 248. Energization of the relay coil 244 is controlled by the thermostat 248 which is subjected to the heat of the oil 124 in the trough 122 of the gluing station. The circuit to the coil 244 is opened and closed by the thermostat 248 as dictated by the oil temperature. When energized, the coil 244 closes the switch 246 to connect the heater element 126 across the lines 234 and 236. The stripper wire 146 is energized continuously.

OPERATION

Switches 238 and 242 are closed to energize the drive motor 156 and heat the glue to the desired temperature. At the beginning of a run, all of the trays 26 will be empty. The operator stands in front of the machine at the loading area facing the tray 26*a* that is in the loading position. The first pad P is placed in the tray 26*a* as illustrated in phantom lines in FIG. 1 (it is assumed that the operator desired to use the left edge guide 64). At this time, the clamp 88 associated with the tray 26 is open.

When the inside edge of the pad is placed against the jogging bar 68, its presence is sensed by the closure of the microswitch 224. This energizes the clutch solenoid 202 to engage the clutch mechanism and commence rotation of the driven shaft 178 (FIG. 10). The drive rod 206 is in the position illustrated in full lines in FIG. 3 with its head 208 engaging the lug 212 associated with the tray 26 just beneath the tray 26*a*. The drive rod 206 reciprocates between this position and the position illustrated in phantom lines as the crank 204 rotates. Being initially at the end of its driving stroke (full lines), the drive rod 206 must complete a return stroke to the phantom line position before it can engage the next lug 212 and advance the carrier. Completion of the return stroke requires approximately one-half revolution of the driven shaft 178 and crank 204; this provides a delay period during which time the clamp 88 is closed and the jogging bar solenoid 76 is energized.

More particularly, after about one-third of a revolution of the driven shaft 178, the cam 184 actuates its associated cam switch 188 to close the power circuit to the clamp actuating solenoid 114. Referring to FIG. 6, it may be seen that the roller 106 on the crank arm 104 of the operating mechanism 90 is bearing against the end piece 112 of the rail 108. When the solenoid 114 is energized, the trip dog 118 is rotated counterclockwise to withdraw its roller 120 from supporting engagement with the piece 112. Accordingly, the roller 106 and associated crank arm 104 shift in a clockwise direction under the action of the two springs 100 to close the clamp 88 against the upper surface of the pad P. Shortly thereafter, at approximately one-half revolution of the driven shaft 178, the cam 186 actuates its cam switch 190 to energize the jogging bar solenoid 76.

The effect of energization of solenoid 76 is illustrated in FIG. 5 where it may be seen that the jogging bar 68 swings rearwardly on hinges 70 under the action of the spring 74. The jogging bar 68 is now clear of the tray 26*a* and its pad so that the same may be advanced from the loading position without interference of the jogging bar 68 with the pad edge 142 to which glue is to be ultimately applied.

During this first half revolution, the drive rod 206 is undergoing its return stroke in response to clockwise rotation of the crank 204 (as viewed in FIG. 3). The rod 206 is guided by the roller 210 which rides on the inner circular surface of frame member 24. At the end of its return stroke, the drive head 208 slips beneath the next lug 212; the ramp 214 leading to such lug 212 assists in guiding the head 208. Accordingly, during the second half revolution of driven shaft 178, the head 208 pushes against the engaged lug 212 to rotate the carrier one increment in a clockwise direction as viewed in FIGS. 2, 3 and 6–9. Since the microswitch 224 reopens at the time that the jogging bar 68 is swung clear of the loaded pad (FIG. 5), the clutch solenoid 202 is deenergized at that time thereby limiting rotation of the driven shaft 178 to one revolution.

Returning to the clamp actuating solenoid 114 and the illustrations of FIGS. 6 and 7, energization of solenoid 114 is only momentary due to the narrow lobe presented by cam 184. Accordingly, as the tray 26*a* commences movement away from the loading position the end piece 112 of rail 108 is free to return to the disposition thereof illustrated in FIG. 6 under the action of the return spring 121 connected to dog 118. The roller 106 of the operating mechanism 90 associated with the next tray will, therefore, be supported by the end piece 112 in the same manner until the trip dog 118 is again rotated by the solenoid 114.

The jogging bar 68 also returns to its normal position after the tray 26*a* leaves the loading position. The lobe presented by cam 186 is of sufficient length to assure that the pad is completely clear of the bar 68 before cam switch 190 is reopened to deenergize solenoid 76. When power is removed from solenoid 76, its armature 78 is no longer held and is free to shift outwardly (to the left in FIG. 7) as the crank link 82 is rotated counterclockwise about pivot pin 84 under the action of return spring 80. This forces roller 86 into engagement with the back side of the jogging bar 68 to return it to its normal position and lock it in such position in readiness for the loading of the next tray.

Referring to FIG. 3 and designating the loading position of a given tray 26 as the first position thereof, the application of glue to the edge 142 occurs as each tray advances from its fifth to its sixth position at the top of the circular path of travel. Glue is applied as described previously in a transverse sweep, as the entire length of the advancing edge 142 simultaneously meets the zone of contact 144 of the glue roll surface. Any excess is removed by the stripper wire 146, with the result that a uniform layer of the adhesive of proper thickness is applied to the edge 142. Although, beginning at the sixth position and continuing to the bottom of the circular path, the pads P will be inverted, the pressure of the clamps 88 of the respective feeder units 20 holds the sheets or leaves in place at the inner margin of each tray 26 so that the glued edge is not disturbed.

Figure 9:
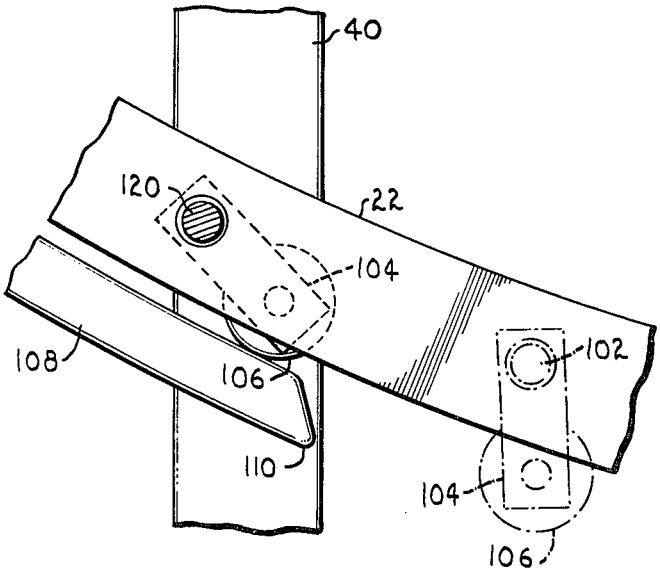
FIG. 9 is a detail view illustrating the manner in which the clamp operating mechanism of each tray is actuated to open the holding clamp of the tray as it arrives at the delivery position.

The tray **26*b* in the delivery position is seen in FIGS. 1–3; this is the third position past the bottom of the circular path. As each tray approaches the delivery position, its clamp 88 is opened to release the glued product for delivery of the same by gravity. The lower end 110 of the rail 108 causes the clamp 88 to open as illustrated in FIG. 9. The roller 106 on the crank arm 104 of the clamp operating mechanism 90 is shown in FIG. 9 in full and broken lines at the termination of that increment of rotation of the carrier. The phantom line illustration shows the same parts just prior to engagement of the roller 106 with end 110. As is evident, the crank arm 104 is forced to rotate counterclockwise by the presence of the rail 108 to, in turn, cause like rotation of the cross shaft 102 and the cranks 96 of the mechanism. Referring to FIG. 6, this drives the posts 92 upwardly (as viewed in FIG. 6) to raise the clamp 88. Accordingly, the parts of the mechanism 90 are oriented as illustrated in FIG. 6 so long as the roller 106 is supported on the rail 108 or the rail end piece 112** as will be the case when the tray is at the loading position as discussed above.

The exact point in the circular path at which the finished pads will be released is, of course, controlled by the precise location of the lower end 110 of the rail 108. The end 110 may be located as desired to accommodate conventional delivery systems well known in the art, such as a belt conveyor 250 illustrated in phantom lines in FIG. 2, a delivery chute or other arrangement as may be dictated by the particularly installation. At the end of the run, the clear switch 240 (FIG. 11) is closed to maintain the clutch solenoid 202 in an energized state; this causes the driven shaft 178 to rotate continuously so that the loaded trays will be successively advanced through the delivery position.

Having thus described the invention, what is claimed as new and desired to be secured by Letters Patent is:

1. A padding machine comprising:

a carrier rotatable about a generally horizontal axis;

a plurality of feeder units each adapted to receive a multi-leaved product such as a pad or book, said units being mounted on said carrier, radially spaced from said axis, and spaced from one another at angular intervals about said axis;

drive means coupled with said carrier for incrementally rotating the latter to advance individual units in succession in a circular path from a loading position to a delivery position and back to said loading position, each of said units being provided with means for releasably holding a product loaded thereinto in a disposition in which an edge of the product to be glued extends substantially parallel to said axis of the carrier;

control means operably coupled with said drive means and responsive to loading of the unit at said loading position for actuating the drive means to cause said carrier to rotate one increment and advance the next unit to the loading position;

means adjacent said path for applying glue to said edge of the product in each unit after advancement from said loading position; and means for operating the holding means of each unit to release the glued product when the unit reaches said delivery position, said glue applying means comprising a gluing station located between a pair of adjacent, successive positions of said units, said station including an applicator having an elongated zone of contact for engagement by said edge of each product as said units pass in succession between said pair of positions, and means supporting said applicator with said zone thereof extending substantially parallel to said axis, whereby the entire length of the advancing edge to be glued simultaneously engages the applicator at said zone, said applicator being a rotatable roll having an outer surface presenting said zone and over which glue is spread, and said supporting means mounting said roll with its axis of rotation extending substantially parallel to said axis of the carrier, said gluing station further including an elongated stripper wire extending parallel with said axis of the roll and spaced from said zone in the direction of advancement of said units, and means mounting said wire in closely spaced relationship to the glued edge of each advancing product for removal of excess glue therefrom.

2. The machine as claimed in claim 1, wherein said gluing station further includes means connected with said roll for rotatably driving the latter at a surface speed substantially equal to the speed of the advancing edge of each product as it engages said zone, whereby to prevent the pileup of glue on the leading or trailing portions of said edge.

3. A padding machine comprising:

a carrier rotatable about a generally horizontal axis;

a plurality of trays each adapted to receive a multileaved product such as a pad or book, said trays being mounted on said carrier, radially spaced from said axis, and spaced from one another at angular intervals about said axis;

drive means coupled with said carrier for incrementally rotating the latter to advance individual trays in succession in a circular path from a loading position; to a delivery position and back to said loading position;

a holding device on each tray engageable with a product loaded flat on the tray for releasably holding the product securely on the tray;

a jogging bar extending substantially parallel to said axis and against which an edge of each product is placed when the product is loaded:

means mounting said bar adjacent the tray at said loading position for movement between a normal, operative position and a position clearing the tray and product thereon;

control means operably coupled with said drive means and responsive to loading of the tray at said loading position for actuating the drive means to cause said carrier to rotate one increment and advance the next tray to the loading position, and including means coupled with said bar for shifting the latter to its product-clearing position prior to commencement of rotation of said carrier;

means adjacent said path for applying glue to said edge of the product in each tray after advancement from said loading position; and means for operating the holding device of each tray to release the glued product when the tray reaches said delivery position.

4. The machine as claimed in claim 3, further comprising means mounting said trays substantially in angularly spaced planes intersecting at a common line defining said axis of the carrier.

5. The machine as claimed in claim 3, wherein said holding device of each tray includes clamp means for engaging a product loaded on the tray and mechanism for operating said clamp means, and wherein said control means further includes sensing means associated with said jogging bar for detecting the presence of a loaded product, and means for actuating the mechanism of the tray at said loading position to engage the clamp means thereof with the loaded product prior to shifting said bar to its product-clearing position and commencement of rotation of said carrier.

6. The machine as claimed in claim 5, wherein said means for operating the holding device of each tray to release the glued product is disposed in said path of the trays adjacent said delivery position for engagement with the clamp operating mechanism of each tray as it arrives at said delivery position.

7. A padding machine comprising:

a carrier rotatable about a generally horizontal axis;

a plurality of trays each adapted to receive a multileaved product such as a pad or book, said trays being mounted on said carrier, radially spaced from said axis, and spaced from one another at angular intervals about said axis;

drive means coupled with said carrier for incrementally rotating the latter to advance individual trays in succession in a circular path from a loading position to a delivery position and back to said loading position;

a holding device on each tray engageable with a product loaded flat on the tray for releasably holding the product securely on the tray;

jogging bar means extending substantially parallel to said axis and against which an edge of each product is placed when the product is loaded;

control means operably coupled with said drive means and responsive to loading of the tray at said loading position for actuating the drive means to cause said carrier to rotate one increment and advance the next tray to the loading position;

means adjacent said path for applying glue to said edge of the product in each tray after advancement from said loading position; and means for operating the holding device of each tray to release the glued product when the tray reaches said delivery position.

8. A padding machine comprising:

a carrier rotatable about a generally horizontal axis;

a plurality of trays each adapted to receive a multileaved product such as a pad or book, said trays being mounted in said carrier, radially spaced from said axis, and spaced from one another at angular intervals about said axis, and each tray presenting inner and outer margins radially spaced with respect to said axis;

drive means coupled with said carrier for incrementally rotating the latter to advance individual trays in succession in a circular path from a loading position to a delivery position and back to said loading position;

a holding device on each tray engageable with a product loaded flat on the tray for releasably holding the product securely on the tray;

a jogging bar adjacent said inner margin of the tray at said loading position, extending substantially parallel to said axis, and against which an edge of each product is placed when the product is loaded;

control means operably coupled with said drive means and responsive to loading of the tray at said loading position for actuating the drive means to cause said carrier to rotate one increment and advance the next tray to the loading position;

means adjacent said path for applying glue to said edge of the product in each tray after advancement from said loading position; and means for operating the holding device of each tray to release the glued product when the tray reaches said delivery position.

9. The machine as claimed in claim 8, wherein each tray at said loading position is generally horizontally disposed to receive a product loaded thereinto against said bar from outside said circular path.

10. The machine as claimed in claim 8, wherein said glue applying means comprises a gluing station located inside said circular path between a pair of adjacent, successive positions of said trays, said station including an applicator having an elongated zone of contact for engagement by said edge of each product as said trays pass in succession between said pair of positions, and means supporting said applicator with said zone thereof extending substantially parallel to said axis, whereby the entire length of the advancing edge to be glued simultaneously engages the applicator at said zone.

11. The machine as claimed in claim 10, wherein said applicator is a rotatable roll having an outer surface presenting said zone and over which glue is spread, said supporting means mounting said roll with its axis of rotation extending substantially parallel to said axis of the carrier.

12. The machine as claimed in claim 11, wherein said gluing station further includes means connected with said roll for rotatably driving the latter at a surface speed substantially equal to the speed of the advancing edge of each product as it engages said zone, whereby to prevent the pileup of glue on the leading or trailing portions of said edge.

13. The machine as claimed in claim 11, wherein said gluing station further includes an elongated stripper wire extending parallel with said axis of the roll and spaced from said zone in the direction of advancement of said trays, and means mounting said wire in closely spaced relationship to the glued edge of each advancing product for removal of excess glue therefrom.

14. A padding machine comprising:

a carrier rotatable about a generally horizontal axis and including a circular frame member concentric with said axis;

a plurality of trays each adapted to receive a multileaved product such as a pad or book, said trays being mounted on said carrier, radially spaced from said axis, and spaced from one another at angular intervals about said axis;

means mounting said trays substantially in angularly spaced planes intersecting at a common line defining said axis of the carrier;

drive means coupled with said carrier for incrementally rotating the latter to advance individual trays in succession in a circular path from a loading position to a delivery position and back to said loading position;

a holding device on each tray engageable with a product loaded flat on the tray for releasably holding the product securely on the tray;

control means operably coupled with said drive means and responsive to loading of the tray at said loading position for actuating the drive means to cause said carrier to rotate one increment and advance the next tray to the loading position;

means adjacent said path for applying glue to an edge of the product in each tray after advancement from said loading position; and means for operating the holding device of each tray to release the glued product when the tray reaches said delivery position, said drive means including a plurality of lugs on said member angularly spaced at intervals corresponding to the angular spacing of said planes, and a reciprocable drive rod having a driving stroke and a return stroke, said rod engaging each lug in succession with each driving stroke thereof, said control means effecting one reciprocation of said rod in response to loading of the tray at said loading position.

* * * * *

UNITED STATES PATENT OFFICE

CERTIFICATE OF CORRECTION

PATENT NO. : 4,014,288

DATED : March 29, 1977

INVENTOR(S) : LORREN F. LUDLUM

It is certified that error appears in the above-identified patent and that said Letters Patent are hereby corrected as shown below:

Claim 3:

Column 12, line 49, delete the semicolon between "position" and "to".

Column 12, line 56, change the colon to a semicolon.

Signed and Sealed this

Twenty-first Day of June 1977

[SEAL]

*Attest:*

RUTH C. MASON
*Attesting Officer*

C. MARSHALL DANN
*Commissioner of Patents and Trademarks*